United States Patent [19]

Mitchell et al.

[11] Patent Number: 4,637,570

[45] Date of Patent: Jan. 20, 1987

[54] DRAG STABILIZER

[75] Inventors: Gregory N. Mitchell, St. Mary County; Ronald A. Wilson, Calvert County, both of Md.

[73] Assignee: The United States of America as represented by the Secretary of the Navy, Arlington, Va.

[21] Appl. No.: 689,890

[22] Filed: Jan. 9, 1985

[51] Int. Cl.[4] ..... F41J 9/08

[52] U.S. Cl. ..... 244/1 TD; 273/360

[58] Field of Search ..... 244/1 TD, 138 R, 3.24; 114/311, 244; 102/384, 386; 403/259, 260, 261; 273/360

[56] References Cited

U.S. PATENT DOCUMENTS

| | | | |
|---|---|---|---|
| 1,048,509 | 12/1912 | Durgan | 244/124 |
| 2,287,257 | 6/1942 | Lear | 244/1 TD |
| 2,873,674 | 2/1959 | Lyon | 102/385 |
| 2,953,377 | 9/1960 | Brust | 102/384 |
| 3,204,890 | 9/1965 | Lehn et al. | 244/3 |
| 3,251,565 | 5/1966 | Haist | 244/1 TD |
| 3,310,257 | 3/1967 | Price | 244/1 TD |

*Primary Examiner*—Galen Barefoot
*Assistant Examiner*—Mark R. Valliere
*Attorney, Agent, or Firm*—Thomas E. McDonnell; Elmer E. Goshorn

[57] ABSTRACT

A drag stabilizer for a towed airborne cylindrical object comprises a flared body of a closed cell foam, an attachment plate that is connected to the towed object and has a central post for holding the flared foam body, and a securing plate that is connected to the center post, thereby holding the foam body on the center post.

11 Claims, 2 Drawing Figures

DRAG STABILIZER

BACKGROUND OF THE INVENTION

The invention pertains generally to flight stabilizers and particularly to flight stabilizers for towed objects.

Objects towed from aircraft frequently have a drag component attached to it in order to stabilize the flight of the object and to assist in the extension of the object from the plane. The drag stabilizer is often referred to as drogue, cup, skirt or sock. It operates by increasing the amount drag being exerted on the connecting cable, thereby assisting the extension of the object, and by creating a partial vacuum behind the object, thereby minimizing oscillations and movements of the object in the air stream.

Certain design principles have been developed. The drag stabilizer generally has a frontal cross section smaller than the back cross section in order to prevent excessive drag. One common shape is a right frustocone, such as the drogue in U.S. Pat. No. 3,310,257 by E. N. Price, or the magnetic anomally detector (MAD) skirt in U.S. Pat. No. 3,204,890. Another shape frequently used is a bell, such as the cup in U.S Pat. No. 2,287,257 by W. P. Lear, or the drogue in U.S. Pat. No. 3,251,565 by M. C. Haist.

For larger towed objects, the drag component experiences instabilities arising from laminar flow along its surface and turbulent air effects behind it. Longitudinal holes are made through the drag component in order to eliminate or reduce the instabilities. Examples are found in U.S. Pat. Nos. 3,204,890 and 3,310,257.

The presently used drag skirt, or stabilizer, for a magnetic anomally detector (MAD) is a partially hollow right frustocone made from fiberglass and is attached to the detector by nonmagnetic beryllium copper screws in an arrangement similar to that shown in U.S. Pat. No. 3,204,890. This drag skirt has proven to be extremely expensive for several reasons.

The drag skirt is often cracked and ruined during landing, maintenance and flight. Approximately 50 skirts have to be replaced each year. Vibrations and shocks cause the relatively soft attaching screws to loosen or fail, causing the detector to fall in the sea. Impact on the water cracks or breaks the skirt and the entire detector assembly sinks. Approximately 30 detector assemblies are lost each year. The cost of the skirt is high because of the cost of the materials, the number of manufacturing operations, and the long manufacturing time.

SUMMARY OF THE INVENTION

It is, therefore, an object of this invention to increase the ruggedness of drag skirts for cylindrical towed objects.

Another object of this invention is to increase the probability of retrieving a towed object, such as a magnetic anomally detector, after a fall into the sea.

A further object of this invention is to decrease the cost of drag stabilizers for towed objects.

These and other objects are achieved by a three-piece drag stabilizer assembly comprising a hard, tough plastic attachment plate with a tube extending from the middle of one side of the attachment plate, a flared body of a closed cell, tough, high-buoyancy, low-density foam that surrounds the tube, and a hard, tough plastic securing plate adapted to attach to the tube extending through the flared body of foam.

DETAILED DESCRIPTION OF THE INVENTION

Figure 1:
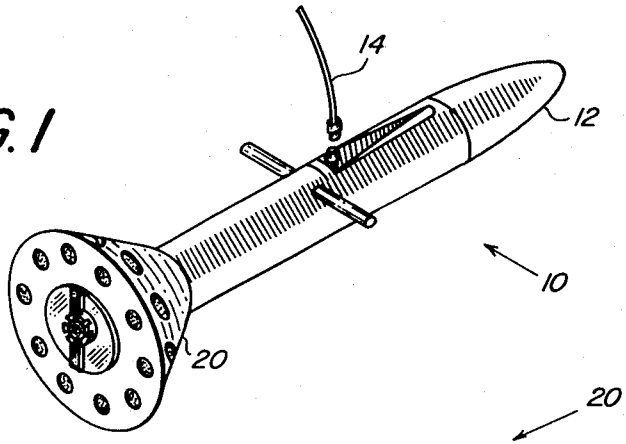
FIG. 1 is a perspective of a magnetic anomally detector with a drag stabilizer of the present invention.

FIG. 1 shows a magnetic anomally detector assembly 10 which comprises a magnetic anomally detector 12, a cable 14 that connects the detector and an aircraft, not shown, and the drag stabilizer of the present invention 20 that is attached at the aft end of the detector. The present drag stabilizer can be used with any other cylindrical-shaped object that is towed by an aircraft.

Figure 2:
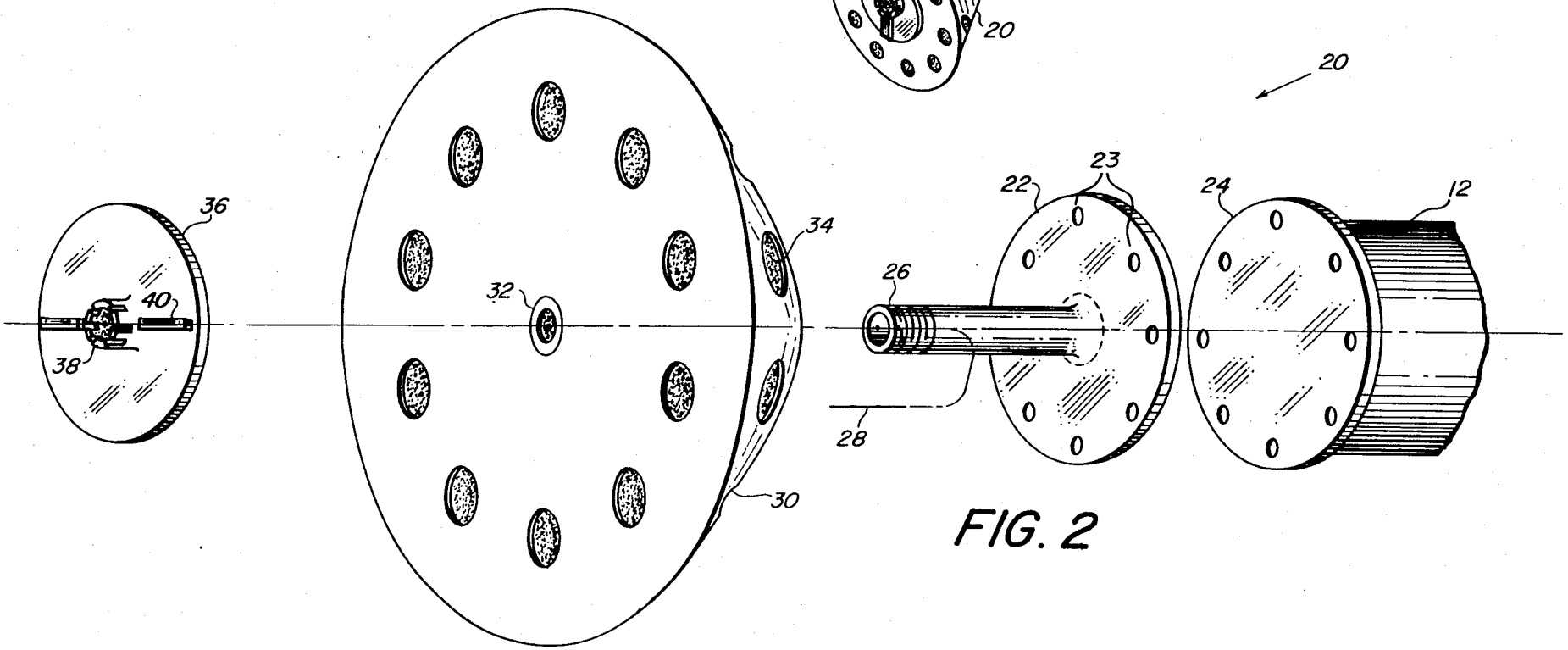
FIG. 2 is a perspective of a drag stabilizer assembly of the present invention.

The drag stabilizer 20 shown in FIG. 2 illustrates the preferred embodiment of the present invention. The stabilizer comprises an attachment plate 22 which has a plurality of holes 23 for connecting the plate 22 with the attachment plate 24 of the towed object 12 by screws or bolts, and a centrally located post 26 that is preferably hollow and extends at about 90° from one side of the plate 22. The post is preferably threaded for easy attachment to the securing plate 36.

The securing plate 36 attaches to the central post 26 of the attachment plate 22 by a threaded central hole 38. An increased number of threads can be obtained with a threaded raised area around the central hole 38. A small handle 40 is included to facilitate the use of the securing plate 36. The central plate 36 is prevented from accidentally coming off by a securing pin 28. The securing plate 36 is preferably from about one fifth to about three fourths of the aft diameter of the foam body. It is necessary for the securing plate to provide sufficient surface area to support and hold the foam body 30 but to have its peripheral edge recessed from the peripheral edge of the foam body. Preferably the diameter of the securing plate is from one third to one half of the aft diameter of the foam body 30.

The material of the attaching plate and the securing plate is identical or nearly identical since they are interlocking pieces. The material is light but hard, has a large load-bearing capacity, is resilient, has a good abrasion and impact resistance, is water resistant and uv-stable. The material meets the following specifications. Hardness is not less than about 80 on the Durometer-A scale and not in excess of about 120 on the Rockwell-R scale. Impact resistance is not less than about 500 Joules/m at 24° C. as determined by ASTM D-256 and not less than about 45 J/m at −40° C. as determined by ASTM D-256. Tensile strength is not less than about 20 MPa at 24° C. and about 15 MPa at 50° C. Water absorption is not greater than about one percent after 24 hours submersion. Specific gravity is not greater than about 1.6.

The preferred material is a polyether-based urethane prepared from polytetramethyleneglycol and toluene diisocyanate.

The foam body 30 of the drag stabilizer 20 has a front diameter equal to the diameter of the attaching plate 22 and outwardly flares to a back diameter from about 2 to about 4 times, and preferably from 2 to 3 times greater than the front diameter. The angle of flaring varies from about 30° to about 60° and preferably from 40° to 50°. To reduce the low-pressure region behind the stabilizer and thereby increase the stability of the towed object in flight, the body 30 has a plurality of holes 34. Typically the number of holes ranges from 6 to 12. The foam body 30 has a central hole 32 for passing through the central post 26 of the attachment plate 22.

The foam of the body is closed cell, absorbs less than one weight percent of water after 24 hours submersion, has a buoyancy of at least about 45 pcf (lb/cu. ft.) as determined by ASTM D 3575 Test AA, has a tensile strength of at least about 40 psi as determined by ASTM D 3575 Test E, has a tear strength of at least about 10 lb/in, is non-magnetic; and has a density of not more than about 3 lb/cu. ft. The preferred foam is closed cell polyethylene foam.

If the drag stabilizer is used with a magnetic anomally detector (MAD), all materials are nonmagnetic. Since the most readily available plastics and foams are organic and nonmagnetic, the stabilizer of this invention is particularly useful with magnetic anomally detectors. The nonmagnetic property of the materials and reduced number of metal screws are important advantages of this stabilizer. Of course the few metal screws needed to attach the attachment plate to the detector should be as nonmagnetic as possible.

The durability of the foam and the rugged assembly made possible by the interconnecting plates have increased the useful life by 50-fold. No longer does the body crack and break during handling and landing If the towed object or the drag stabilizer does become separated from the airplane, the stabilizer does not break up and sink upon impact with the water. The foam and plastic used are easily machined into the aforedescribed parts The threaded post and threaded securing plate permit rapid assembly and disassembly.

Many obvious modifications and embodiments of the specific invention, other than those set forth above, will readily come to mind to one skilled in the art having the benefit of the teachings presented in the foregoing description and the accompanying drawings of the subject invention, and hence it is to be understood that such modifications are included within the scope of the appended claims.

What is claimed is:

1. A drag stabilizer for a towed cylindrical object which comprises:

a body having a shape with a diameter smaller in front than in back, having a hole along and through the longitudinal axis, having a plurality of holes parallel with the central hole and comprises a closed-cell foam with a density of not greater than about three pcf, a buoyancy of at least about 45 pcf, a tensile strength of at least about 40 psi, a tear strength of at least about 10 lb/in, and a water absorption of less than about one weight percent of total foam weight;

an attachment plate for rigidly attaching said body to said towed object, said plate comprising a plastic with a hardness from about 80 on the Durometer-A scale to about 120 on the Rockwell-R scale, an impact resistance of not less than about 500 J/m at 24° C. and of not less than about 45 J/m at 40° C., a tensile strength of not less than about 20 MPa at 24° C. and not less than about 15 MPa at 50° C., a specific gravity of not more than about 1.6, and a water absorption of not more than one weight percent after 24 hours submersion and said plate having a means for rigidly attaching said plate to said towed object and having a tube normal to one side for passing through said central hole of said body, thereby attaching said body to said towed object; and a securing plate having a diameter less than the back diameter of said body, having a means for attaching to said tube of said attachment plate, thereby holding said body on said tube, and comprising a material similar to the material of said attachment plate.

2. The drag stabilizer of claim 1 wherein said foam is nonmagnetic and said attachment plate and securing plate are nonmagnetic.

3. The drag stabilizer of claim 2 wherein the front diameter of said body is equal to the diameter of the attachment plate, the back diameter is from 2 to 4 times larger, and the angle of flaring from about 30° to about 60°.

4. The drag stabilizer of claim 3 wherein the angle of flaring is from 40° to 50°.

5. The drag stabilizer of claim 4 wherein the central post of said attachment plate has a threaded end.

6. The drag stabilizer of claim 5 wherein said securing plate has a threaded central hole for engaging said threaded end of said center post.

7. The drag stabilizer of claim 6 wherein said body comprises a closed cell polyethylene foam and said attachment plate and securing plate comprise an aromatic ether based polyurethane.

8. The drag stabilizer of claim 3 wherein the central post of said attachment plate has a threaded end.

9. The drag stabilizer of claim 8 wherein said securing plate has a threaded central hole for engaging said threaded end of said center post.

10. The drag stabilizer of claim 9 wherein said body comprises a closed cell polyethylene foam and said attachment plate and securing plate comprise an aromatic ether based polyurethane.

11. The drag stabilizer of claim 2 wherein said body comprises a closed cell polyethylene foam and said attachment plate and securing plate comprise an aromatic ether based polyurethane.

* * * * *